United States Patent [19]

Courson

[11] 4,159,758

[45] Jul. 3, 1979

[54] TRANSPORTATION APPARATUS

[75] Inventor: Iber C. Courson, Gettysburg, Pa.

[73] Assignee: Westinghouse Electric Corp., Pittsburgh, Pa.

[21] Appl. No.: 834,365

[22] Filed: Sep. 19, 1977

[51] Int. Cl.[2] ..... B66B 9/14

[52] U.S. Cl. ..... 198/335; 52/586; 52/726; 403/274; 403/297; 403/313

[58] Field of Search ..... 198/326, 335, 337; 104/25; 403/274, 278, 297, 373, 309–313; 52/586, 726

[56] References Cited

U.S. PATENT DOCUMENTS

| | | | |
|---|---|---|---|
| 1,941,498 | 1/1934 | Shonnard | 198/335 |
| 2,290,430 | 7/1942 | Heiser | 403/297 |
| 3,484,830 | 12/1969 | Wagner et al. | 403/297 |
| 3,989,133 | 11/1976 | Courson et al. | 198/335 |

*Primary Examiner*—Joseph E. Valenza
*Attorney, Agent, or Firm*—D. R. Lackey

[57] ABSTRACT

Transportation apparatus for transporting persons between spaced landings, including a conveyor mounted on a supporting structure, and first and second spaced skirts disposed on opposite sides of the conveyor which are formed of aligned skirt sections. The skirt sections of each skirt are interconnected via expandable splice assemblies which align the interconnected skirt sections, both laterally and vertically, and also lock them in end-to-end relation.

5 Claims, 9 Drawing Figures

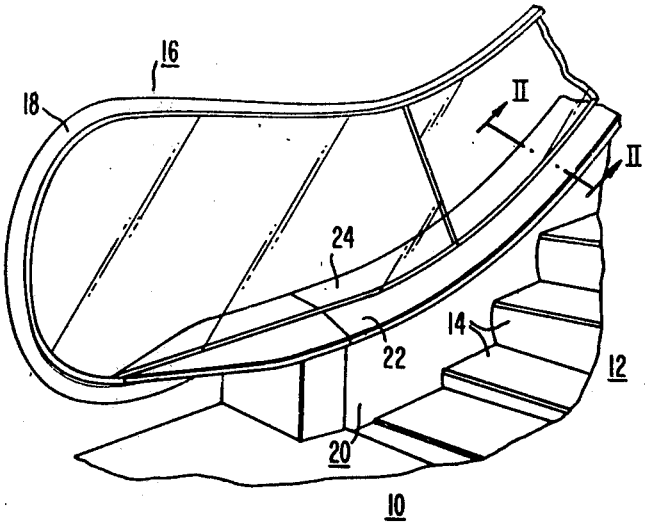
FIG. 1
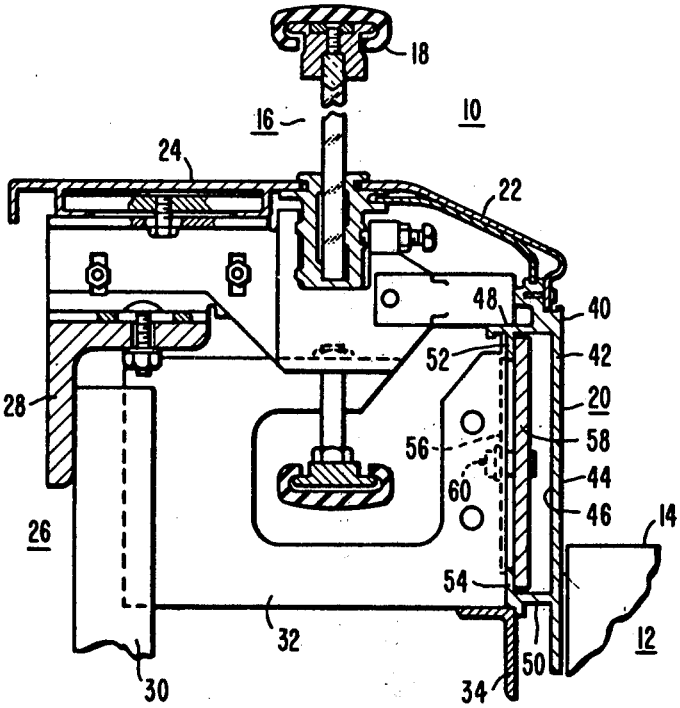
FIG. 2
PRIOR ART
FIG. 4
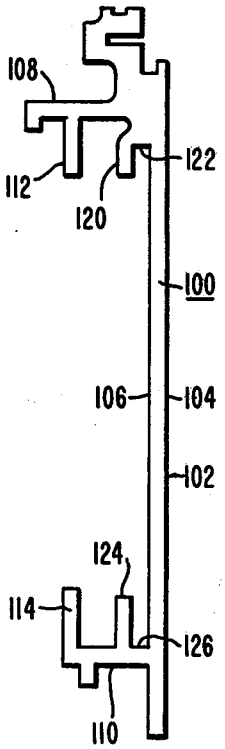

TRANSPORTATION APPARATUS

BACKGROUND OF THE INVENTION

1. Field of the Invention

The invention relates in general to transportation apparatus for moving people between spaced landings, such as movable stairways and walks.

2. Description of the Prior Art

Transportation apparatus for moving people from one landing to another, such as moving stairways and walks, include a conveyor or endless belt mounted on a supporting structure. A plurality of steps, platforms or pallets, are fastened to the endless belt, and skirt panels are mounted on each side of the conveyor, immediately adjacent to the moving steps, platforms or pallets. The skirt panels, on each side of the conveyor, are commonly formed of a plurality of skirt sections disposed in end-to-end relation to provide a continuous skirt structure. Skirt mounting brackets are attached to the supporting structure, and the skirt sections are fastened to the skirt mounting brackets. Skirt splices interconnect the abutting ends of adjacent, aligned skirt sections.

In a typical prior art arrangement, the skirt mounting brackets and skirt splices are fastened to the same structural portions of the skirt sections. Thus, it is not possible to have a skirt mounting bracket at the location of a skirt joint and splice. Further, typical prior art skirt splices are bulky, complex and costly as they must include adjustment features for both lateral and vertical alignment of the skirt sections, as well as a locking feature for securely interconnecting the skirt sections.

It would be desirable to be able to locate the skirt mounting brackets without regard to the locations of the skirt joints and splices, as this would facilitate field assembly of such apparatus. It would also be desirable to simplify the skirt splice and reduce its cost. However, any changes incorporated to accomplish these objectives must retain the essential adjustment and locking features of the prior art skirt splices.

SUMMARY OF THE INVENTION

Briefly, the present invention is new and improved transportation apparatus having skirt panels which include aligned skirt sections interconnected by skirt splices. In the prior art, the skirt mounting brackets are clamped to upper and lower projecting portions, which are integral parts of the skirt panel, which projections are spaced from the skirt wall. The prior art skirt splice is clamped to these same projections. The present invention changes the skirt splice from a clamping device to an expandable device, and it utilizes the skirt wall as a pressure point. Another pressure point is provided by upper and lower projecting portions formed integrally with the skirt panel sections, which are located inside the upper and lower projecting portions utilized by the skirt mounting brackets. Thus, a skirt mounting bracket may be mounted in close proximity to a skirt splice. The skirt splice, being mounted close to the skirt wall, presents little or no interference with a skirt mounting bracket. The new and improved skirt splice also permits movement thereof, right or left, without deleteriously affecting its alignment and locking functions, to provide still additional clearance relative to a skirt mounting bracket.

The expandable splice assembly includes a plate member, the upper and lower edges of which function as tabs which slide into slots defined by the upper and lower projecting portions and the wall portions, of the adjoining skirt sections. Vertical alignment is provided, without hardware, by apertures or slots located close to the upper edge of the plate member. The edge adjacent to these slots is bent outside its normal location by simply placing a screwdriver in each slot and twisting it. Then, when the plate member is advanced into the slots of the skirt sections, the bent portions are contacted and bent back towards their original profile, which forces the bottom edge of the plate member to the bottom of the lower slots, achieving vertical alignment and a tight fit which aids in locking the two sections together. The bent portions accommodate dimensional tolerances in the skirt sections, which sections are normally extruded aluminum configurations, and thus subject to extrusion tolerances.

The skirt splice also includes a pressure element disposed between the plate member and the wall portions of the adjoining skirt sections, which is actuatable against the skirt walls by a plurality of pressure or lock screws which laterally align the skirt sections and complete the locking function.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 1 is a fragmentary, perspective view of transportation apparatus which may be constructed according to the teachings of the invention;

FIG. 2 is a cross-sectional view of the transportation apparatus shown in FIG. 1, taken in the direction of arrows II—II, illustrating a typical prior art skirt and skirt mounting bracket arrangement;

FIG. 4 is an elevational end view of a skirt section constructed according to the teachings of the invention;

DESCRIPTION OF PREFERRED EMBODIMENTS

Figure 3:
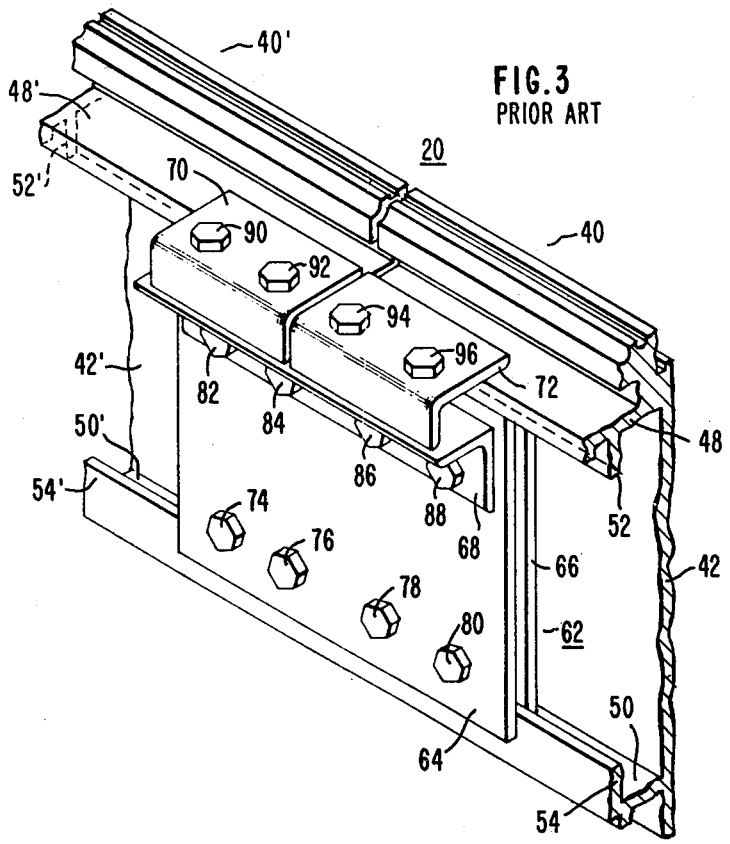
FIG.3 PRIOR ART
FIG. 3 is a perspective view of the skirt shown in FIG. 2, illustrating a typical prior art skirt splice for aligning and interlocking two adjacent skirt sections.

Referring now to the drawings, and to FIG. 1 in particular, there is shown a fragmentary, perspective view of transportation apparatus of the type which may utilize the teachings of the invention. While the transportation apparatus 10 shown in FIG. 1 is an escalator, the invention is equally applicable to moving walks. In order to simplify the drawings, only those details of transportation apparatus 10 which are necessary to understand the teachings of the invention will be described. If additional information relative to the construction of transportation apparatus 10 is desired, U.S. Pat. Nos. 3,989,133 and 3,991,877 may be referred to, which patents are assigned to the same assignee as the present application.

Transportation apparatus 10 includes a conveyor 12 having a plurality of steps 14. Conveyor 12 includes an upper or load bearing run during which passengers stand on the steps 14, and a lower return run. A balustrade 16 is disposed on one side of conveyor 12 for guiding a continuous, flexible handrail 18 about a closed handrail loop. A balustrade (not shown) similar to balustrade 16 is disposed on the remaining side of conveyor 12.

A skirt 20 is disposed immediately adjacent one side of the moving steps 14, with an inner deck 22 providing a smooth transition between the inner wall of the balustrade 16 and the skirt 20. An outer deck 24 provides a smooth transition from the outer wall of the balustrade 16 to the outer extremity of the transportation apparatus 10. Similar skirt and deck assemblies are associated with the balustrade on the other side of the moving steps 14.

Skirt 20 is constructed of a plurality of skirt sections, which skirt sections are usually aluminum extrusions. The sections must be laterally and vertically aligned, and locked together, to achieve a smooth, continuous skirt 20. It is essential that a predetermined tolerance be maintained between the skirt 20 and the steps 14, and that no discontinuities be present which could be a safety hazard. A smooth flowing construction is also necessary from the appearance standpoint.

The present invention is related to improving the construction of transportation apparatus 10, and more specifically to simplify and reduce the cost of the skirt assembly without deleteriously affecting the requisite alignment and locking of the plurality of skirt sections which make up the skirt 20.

In order to better understand the invention, a typical prior art structure will first be described. FIG. 2 is a cross-sectional view of the transportation apparatus 10 shown in FIG. 1, taken in the direction of arrows II—II. Transportation apparatus 10 includes a supporting structure or truss 26, which supports the conveyor 12 and the balustrade 16. The supporting structure 26 includes a truss chord 28 and a plurality of truss upright members, such as truss upright member 30, which members are welded or otherwise secured between truss chords. Skirt mounting brackets, such as skirt mounting bracket 32, are welded or otherwise secured to the truss uprights 30, and to a structural member 34 which provides a dimensional reference for the skirt 20 adjacent to the steps 14.

The skirt 20 includes a plurality of skirt sections disposed in end-to-end relation, such as skirt section 40 shown in cross section in FIG. 2. Skirt section 40 includes a wall portion 42 having a first or outer surface 44 which faces the steps 14, and a second or inner surface 46. Upper and lower lateral projections 48 and 50 are provided on the side of the second or inner surface 46, which projections include depending and upstanding portions 52 and 54, respectively. The depending and upstanding portions 52 and 54 provide projections which cooperate with the skirt mounting bracket 32, as shown in FIG. 2, and with a prior art skirt splice, to be hereinafter described relative to FIG. 3. The skirt mounting bracket 32 includes a clamp assembly having a stationary upstanding portion 56, and a movable portion 58. The stationary and movable portions 56 and 58, respectively, are disposed on opposite sides of the depending and upstanding portions 52 and 54, and they are linked via a screw 60. Screw 60 is actuated to pull the skirt sections 40 tightly against the skirt mounting bracket 32. FIG. 3 is a perspective view of the skirt section 40 shown in FIG. 2, and the next adjoining skirt section, which will be referenced section 40', since it is similar to skirt section 40. FIG. 3 illustrates a prior art skirt splice assembly 62 for aligning and interlocking skirt sections 40 and 40' in end-to-end relation. Skirt splice 62 includes first and second spaced plate members 64 and 66, respectively, a first right angle member 68, second and third right angle members 70 and 72, respectively, and a plurality of nut and bolt combinations 74, 76, 78, 80, 82, 84, 86, 88, 90, 92, 94 and 96. Plate members 64 and 66 are disposed on opposite sides of the upstanding and depending projections 54 and 52, with nut and bolt combinations 74, 76, 78 and 80 interconnecting the plate members adjacent to the upstanding portion 54. Nut and bolt combinations 82, 84, 86 and 88 interconnect the plate members 64 and 66 adjacent to the depending projections 52, and they also serve to fasten one arm of right angle member 68 to plate member 64. Nut and bolt combinations 90, 92, 94 and 96 fasten right angle members 70 and 72 to the other arm of the right angle member 68, which arm extends perpendicularly outward from plate member 64. One arm of each of the right angle members 70 and 72 is disposed in a vertical orientation against the outwardly extending arm of right angle member 68, and their other arms overlap the projections 48 and 48' of skirt sections 40 and 40, respectively. Splice 62 is a pressure device, with the plates 64 and 66 functioning as pressure plates which align the interconnected skirt sections laterally, and they also serve to lock the interconnected skirt sections together. The right angle members also function as a pressure or clamping device, aligning the interconnected skirt sections vertically, and also contributing to the interlocking function. Splice assembly 62 is relatively costly, due to the large number of parts required, and it also requires considerable skill and assembly time to obtain the desired lateral and vertical alignment of adjacent skirt sections, and to securely tighten all twelve of the nut and bolt combinations. Further, the locations of the skirt mounting brackets are fixed by the positions of the truss uprights 30. If a mounting bracket 32 happens to fall at the same location as a joint between two skirt sections, a problem is created since the skirt mounting brackets and skirt splice utilize the same projections 52 and 54 on the skirt for cooperating with clamping functions.

The present invention eliminates the interference problem between the skirt mounting brackets and skirt splices. This objective is achieved by making only a minor modification to the skirt sections, while simplifying and reducing the cost of the skirt splice assembly. FIG. 4 illustrates an elevational end view of a skirt section 100 constructed according to the teachings of the invention.

More specifically, skirt section 100 includes a vertically oriented wall portion 102 having a first or outer surface 104, a second or inner surface 106, upper and lower lateral projections 108 and 110 which extend perpendicularly outward from the second side 106, and depending and upstanding portions 112 and 114 which extend towards one another from the lateral projections 108 and 110, respectively. Up to this point in the description, the skirt section 100 shown in FIG. 4 is the same as the prior art section 40 shown in FIG. 2. Skirt section 100 additionally includes an upper depending portion 120 spaced from the inner surface 106 of wall 102, to define a first slot 122. Skirt section 100 also includes a lower, upstanding portion 124 spaced from the inner surface 106 of wall 102 to define a second slot 126. The first and second slots 122 and 124, respectively, are vertically aligned and their openings face one another. Since the skirt sections are normally an aluminum extrusion, adding the projections 120 and 124 requires only minor modifications to the extrusion die.

Figure 6:
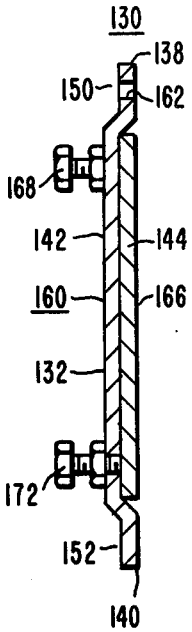
FIG. 6 is a cross-sectional view of the expandable skirt splice shown in FIG. 5, taken between and in the direction of arrows VI—VI.
Figure 5:
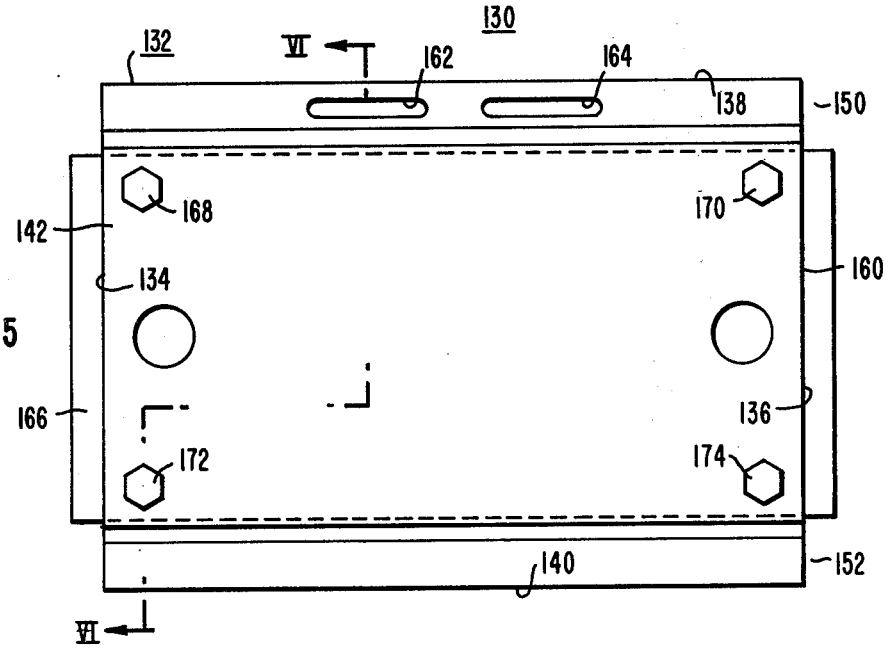
FIG. 5 is a front elevational view of an expandable skirt splice constructed according to the teachings of the invention.

FIG. 5 is a front, elevational view of a new and improved, expandable skirt splice assembly 130, constructed according to the teachings of the invention. FIG. 6 is a cross-sectional view of the expandable splice assembly 130 shown in FIG. 5, taken between and in the direction of arrows VI—VI. Skirt splice assembly 130 includes a plate member 132, which may be formed of any suitable metallic material, such steel. Plate member 132 has first and second ends 134 and 136, respectively, upper and lower edges 138 and 140, respectively, and first and second major, flat opposed surfaces 142 and 144, respectively. Plate member 132 further includes upper and lower tab portions 150 and 152, respectively, which extend completely across the top and bottom of the plate member adjacent to the upper and lower edges 138 and 140, respectively. The upper and lower tab portions 150 and 152 have their major opposed surfaces aligned in common vertical plates. Plate member 132 includes a portion 160 intermediate the tab portions 150 and 152, the major surfaces of which are spaced from and parallel to the major surfaces of the tab portions, defining a recess or space between the tab portions. First and second elongated apertures or slots 162 and 164 are provided in the upper tab 150, adjacent to the upper edge 138. Slots 162 and 164 function to provide vertical alignment of adjacent skirt sections, without hardware, as will be hereinafter explained.

The expandable splice assembly 130 also includes adjustable pressure means. In the preferred embodiment, illustrated in FIGS. 5 and 6, the adjustable pressure means includes a flat pressure plate 166 and four lock screw-lock nut combinations 168, 170, 172 and 174. The pressure plate 166, which may be formed from standard flat sheet steel stock, or any other suitable material, is sized to fit into the recess or space between the upper and lower tabs 150 and 152, respectively. The four lock screw-lock nut combinations 168, 170, 172 and 174 are threadably engaged with the intermediate portion 160 of plate member 132, with their stem ends being connected to the pressure plate 166 such that turning the lock screws changes the location of the pressure plate 166 relative to the intermediate portion 160 of the plate member 132.

The expandable skirt splice 130 shown in FIGS. 5 and 6 is the preferred embodiment because the pressure plate 166 is easily constructed, and it uniformly distributes pressure against the inner wall 106 of the skirt section 100. However, it is to be understood that instead of a single pressure plate, two pressure bars, each associated with a pair of lock screw-lock nut assemblies, may be used, or, each lock screw may be associated with a single pressure pad of its own, as desired.

Figure 8:
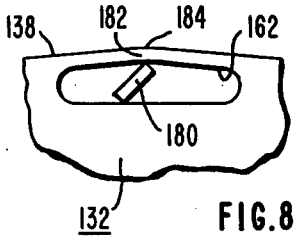
FIG. 8 is a fragmentary view of the skirt splice shown in FIG. 7, illustrating the bending of a portion of the skirt splice to accommodate dimensional tolerances and to insure vertical alignment of adjacent skirt sections.
Figure 7:
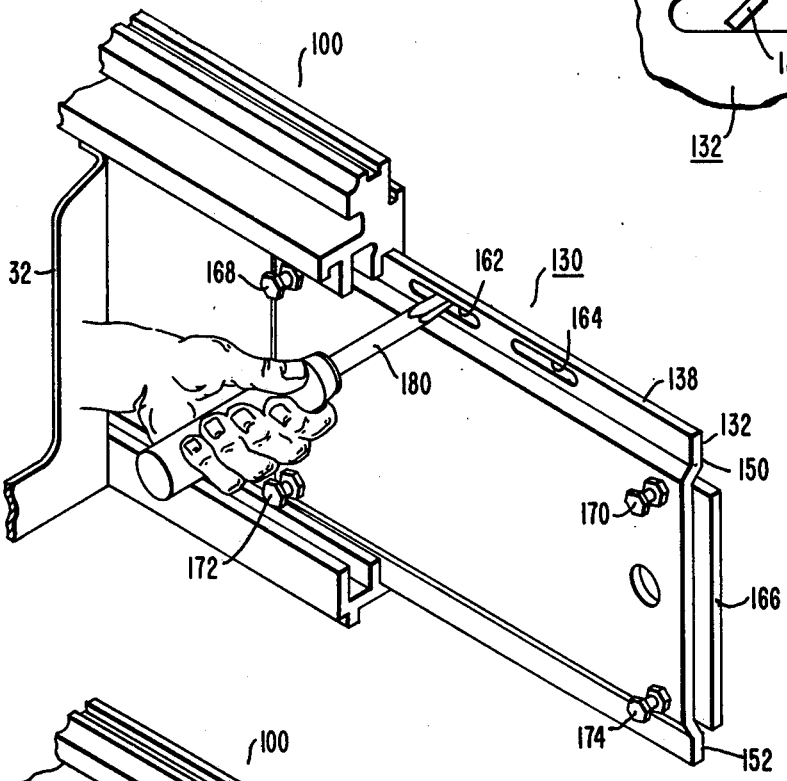
FIG. 7 is a perspective view of the skirt section shown in FIG. 4, and the skirt splice shown in FIGS. 5 and 6, illustrating a step in the assembly of the skirt sections.

FIG. 7 is a perspective view of a skirt section 100 and a skirt splice assembly 130, illustrating a step in the assembly of a skirt. The upper and lower tabs 150 and 152 are inserted into the slots 122 and 126, respectively, on one end of the skirt section 100. At this time, the pressure or lock screws are all loose, permitting the pressure plate 166 to be moved within the recess between the tabs. As illustrated in FIG. 7, a screwdriver 180 is inserted into slot 162 and twisted to bend the upper surface 138 outwardly from its normal position. FIG. 8 is a fragmentary view of plate 132, illustrating the bending of the thin section 182 between the slot 162 and the upper edge of plate 132. The resulting bulge 184 assures a tight vertical fit of the plate 132 in the skirt section extrusion. The skirt splice assembly 130 is then driven into the skirt section 100 until the end of the skirt section is centered on the skirt splice 130. Lock screws 168 and 172 are then tightened to force the pressure plate 166 away from the plate member 132 and against the inner surface 106 of wall 102 of the skirt section.

Figure 9:
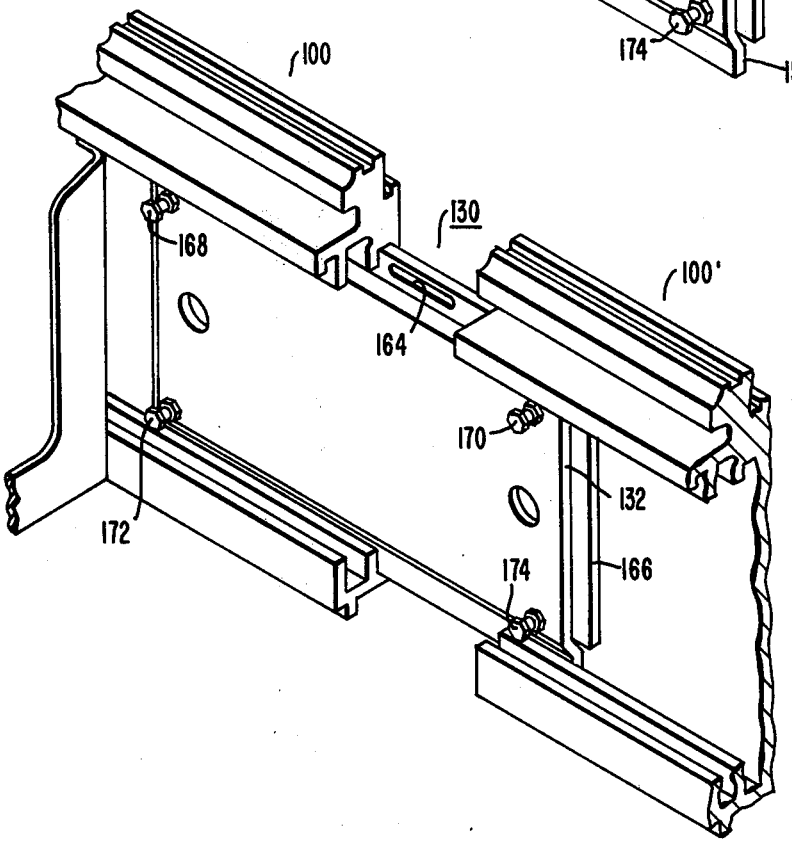
FIG. 9 is a perspective view of two adjacent skirt sections, each similar to the skirt section shown in FIG. 4, and the skirt splice shown in FIGS. 5 and 6, illustrating another step in the assembly of the skirt sections.

The second slot 164 is then twisted in a manner described relative to the first slot 162, and, as illustrated in FIG. 9, a second skirt section 100' is placed in position on the skirt splice 130 and advanced until its end butts against the end of skirt section 100. Screws 170 and 174 are then tightened, and the lock nuts associated with all of the lock screws are tightened.

Since the skirt splice 130 is mounted completely within the skirt sections, between the projections for mounting the skirt mounting brackets and the inner wall of the skirt section, there is absolutely no interference between a skirt mounting bracket and the pressure plates of the skirt splice. The only possible interference which might occur would be when the skirt mounting bracket falls directly in line with a pair of lock screws. In this event, the skirt splice assembly 130 can be moved right, or left, as needed, to enable the lock screws to clear the mounting bracket.

In summary, there has been disclosed new and improved transportation apparatus which greatly facilitates field assembly, because interference between skirt mounting brackets and skirt splices is eliminated. Further, a new and improved skirt splice assembly is disclosed, which operates upon an expandable principle instead of the prior art clamping principle, with one of the pressure points of the new expandable splice assembly being the inner wall of the skirt section itself. Normal manufacturing and extrusion tolerances are accommodated by a structure which also promotes vertical alignment of adjacent skirt sections, without the necessity of utilizing hardware, by providing slots adjacent to the upper edge of a tab, which enables the upper edge to be bent outside of its normal configuration. The bent portions provide upper pressure points which force the lower tab of the pressure plate firmly against the bottom of the lower slot formed in the adjacent skirt sections. Locking pressure is uniformly distributed across a large area of the two adjoining skirt sections, by four lock screw-lock nut combinations which operate upon a pressure plate.

I claim as my invention:

1. Transportation apparatus for transporting persons between spaced landings, comprising:

a supporting structure, a conveyor mounted on said supporting structure, said conveyor having an upper load bearing run and a lower return run, first and second skirts mounted in spaced relation on said supporting structure, on opposite sides of said conveyor, to form substantially vertical walls adjacent to the load bearing run, each of said skirts including a plurality of skirt sections disposed in end-to-end relation, each of said skirt sections having a wall portion and first and second members spaced from a common side of said wall portion which define upper and lower slots, respectively, the openings of which face one another, and expandable splice means disposed to interconnect at least first and second adjacent skirt sections, said expandable splice means including a plate member having upper and lower edges disposed in the upper and lower slots, respectively, of said adjacent skirt sections, and adjustable pressure means in contact with said plate member and the common side of the wall portions of said adjacent skirt sections, said adjustable pressure means providing forces which tend to separate the plate member from said wall portions, to laterally align said adjacent skirt sections and lock them in end-to-end relation, said plate member including first and second openings therein disposed adjacent to a selected one of the upper and lower edges, with the portions of the plate member located between each opening and the adjacent edge being bent outwardly away from the associated openings, said first and second openings being spaced from one another such that the bent edges associated with the first and second openings contact the bottoms of the associated slots in the first and second adjacent skirt sections, respectively, to force the opposite edge of the plate member against the bottom of its associated slots in the first and second adjacent skirt sections, to vertically align the first and second adjacent skirt sections.

2. The transportation apparatus of claim 1 wherein each of the skirt sections includes upright and depending portions, and skirt mounting brackets mounted on the supporting structure which are clamped to said upright and depending portions, and wherein the first and second members which define the upper and lower slots for receiving the plate member of the expandable splice means are disposed between the upright and depending portions and the wall portions of the skirt sections, enabling the skirt mounting brackets to be mounted without interference with the expandable splice means.

3. The transportation apparatus of claim 1 wherein the adjustable pressure means includes first and second screws threadably related to the plate member, with the axial positions of the screws determining the magnitude of the forces which tend to separate the plate member from the wall portions of the adjacent skirt sections.

4. The transportation apparatus of claim 3 wherein the adjustable pressure means includes a pressure element between the plate member and the wall portions of the two adjacent skirt sections, with the first and second screws contacting and forcing the pressure element against the wall portions of the first and second adjacent skirt sections, respectively.

5. Transportation apparatus for transporting persons between spaced landings, comprising:

a supporting structure, a conveyor mounted on said supporting structure, said conveyor having an upper load bearing run and a lower return run, first and second skirts mounted in spaced relation on said supporting structure, on opposite sides of said conveyor, to form substantially vertical walls adjacent to the load bearing run, each of said skirts including a plurality of skirt sections disposed in end-to-end relation, each of said skirt sections having a wall portion and first and second members spaced from a common side of said wall portion which define upper and lower slots, respectively, the openings of which face one another, and expandable splice means disposed to interconnect at least first and second adjacent skirt sections, said expandable splice means including a plate member having upper and lower edges disposed in the upper and lower slots, respectively, of said adjacent skirt sections, and adjustable pressure means in contact with said plate member and the common side of the wall portions of said adjacent skirt sections, said adjustable pressure means providing forces which tend to separate the plate member from said wall portions, to laterally align said adjacent skirt sections and lock them in end-to-end relation, said adjustable pressure means including a plurality of screws and a pressure element, and wherein an intermediate portion of the plate member, between its upper and lower edges, is configured to provide a space between the plate member and the wall portion of the adjacent skirt sections, in which said pressure element is disposed, said plurality of screws being threadably related with said intermediate portion of the plate member, with said plurality of screws being adjusted to urge said pressure element against the wall portions of the adjacent skirt sections.

* * * * *